US011209128B2

(12) United States Patent
Wei

(10) Patent No.: US 11,209,128 B2
(45) Date of Patent: Dec. 28, 2021

(54) PLUG-IN LAMP HOLDER AND LAMP

(71) Applicant: CE LIGHTING LTD., Shenzhen (CN)

(72) Inventor: Yonggang Wei, Shenzhen (CN)

(73) Assignee: CE LIGHTING LTD., Shenzhen (CN)

( * ) Notice: Subject to any disclaimer, the term of this patent is extended or adjusted under 35 U.S.C. 154(b) by 0 days.

(21) Appl. No.: 17/072,765

(22) Filed: Oct. 16, 2020

(65) Prior Publication Data

US 2021/0172569 A1 Jun. 10, 2021

(30) Foreign Application Priority Data

Oct. 16, 2019 (CN) ..... 201910983312.1
Oct. 16, 2019 (CN) ..... 201921740625.6

(51) Int. Cl.
*F21K 9/232* (2016.01)
*F21V 21/002* (2006.01)
(Continued)

(52) U.S. Cl.
CPC ..... *F21K 9/232* (2016.08); *F21V 21/002* (2013.01); *F21V 23/06* (2013.01); *H01R 33/09* (2013.01); *F21Y 2115/10* (2016.08)

(58) Field of Classification Search
CPC ..... F21K 9/232; F21K 9/235; H01R 33/09; H01R 33/46; H01R 13/6276;
(Continued)

(56) References Cited

U.S. PATENT DOCUMENTS 3,056,941 A * 10/1962 Eriksson ..... H01R 13/26 439/256
3,676,835 A * 7/1972 Holly ..... H01K 1/46 439/256

(Continued)

*Primary Examiner* — Peggy A Neils
(74) *Attorney, Agent, or Firm* — Leason Ellis LLP

(57) ABSTRACT

The present invention discloses a plug-in lamp holder and a lamp comprising the plug-in lamp holder. The plug-in lamp holder comprises a lamp cap, an insulation base, a top cover, an L-pole conductive cap, an L-pole conductive spring, at least two N-pole conductive caps and N-pole conductive springs, wherein the top cover is fixedly connected with the insulation base, the L-pole conductive cap extends from the bottom of the center of the insulation base and conducts electricity with an L-pole contact in a threaded lamp socket, the L-pole conductive spring compresses against the insulation base and the L-pole conductive cap, the lamp cap is sleeved on the outer wall of the insulation base, the lamp cap and the L-pole conductive cap are isolated by the insulation base, each N-pole conductive spring is electrically connected, the side wall of the lamp cap is provided with a conductive cap hole, the side wall of the insulation base is provided with an accommodating groove, the position of the conductive cap hole is adapted to the accommodating groove, the N-pole conductive spring is placed in the accommodating groove, and the N-pole conductive cap extends outwards from the conductive cap hole and resists the N-pole conductive spring to make it compressed so as to realize electric conduction with an N-pole threaded portion in a threaded lamp socket, and when the plug-in lamp holder is connected to the threaded lamp socket, axial plugging and unplugging can be performed.

10 Claims, 6 Drawing Sheets

(51) Int. Cl.
*H01R 33/09* (2006.01)
*F21V 23/06* (2006.01)
*F21Y 115/10* (2016.01)

(58) Field of Classification Search
CPC H01R 13/2421; H01R 2107/00; H01R 33/22; F21V 21/002; F21V 23/06; F21Y 2115/10; H01K 1/46
See application file for complete search history.

(56) References Cited

U.S. PATENT DOCUMENTS 5,171,292 A * 12/1992 Ortiz ..... H01R 33/20 439/253
8,314,566 B2 * 11/2012 Steele ..... F21K 9/238 315/185 R
2018/0252392 A1 * 9/2018 Ortiz ..... F21V 19/0075

* cited by examiner

PLUG-IN LAMP HOLDER AND LAMP

TECHNICAL FIELD

The present invention relates to a lamp holder; the present invention further relates to a lamp.

BACKGROUND ART

With the development of science and technology, lighting technology is advancing little by little every day. From incandescent lamps and halogen lamps to energy-saving lamps, LED solid-state lighting is also widely used presently. However, even with the development of lighting technology up to now, the forms and types of lamp holders and lamp sockets have always used the traditional types. For example, E27 and other threaded lamp holders and lamp sockets are still widely applied. Traditional threaded lamp holders require several turns during installation so as to be connected to lamp sockets stably and realize electric conduction, which results in relatively inconvenient installation and use.

SUMMARY OF THE INVENTION

The technical problem to be solved by the present invention is to overcome the shortcomings of the prior art and provide a plug-in lamp holder which is simple in structure and appearance and convenient for installation and use.

The technical solution adopted by the plug-in lamp holder of the present invention is as follows: the plug-in lamp holder of the present invention comprises a lamp cap, an insulation base, a top cover, an L-pole conductive cap, an L-pole conductive spring, at least two N-pole conductive caps and at least two N-pole conductive springs, wherein the top cover is fixedly connected to the insulation base, the L-pole conductive cap extends from the bottom of the center of the insulation base for tight contact with an L-pole contact in a threaded lamp socket to realize electric conduction, the two ends of the L-pole conductive spring are compressed against the insulation base and the L-pole conductive cap respectively so that the L-pole conductive cap can be elastically stretched, the lamp cap is sleeved and fixed on the outer wall of the insulation base, the lamp cap is isolated from the L-pole conductive cap by the insulation base, each N-pole conductive spring is electrically connected, the side wall of the lamp cap is provided with at least two conductive cap holes, the side wall of the insulation base is provided with at least two accommodating grooves, the position of the conductive cap holes is adapted to the position of the accommodating grooves, the N-pole conductive springs are placed in the accommodating grooves, the heads of the N-pole conductive caps protrude outward from the conductive cap holes, the tails of the N-pole conductive caps are placed in the accommodating grooves and resist the N-pole conductive springs to compress them so that the N-pole conductive caps can be elastically stretched for tight contact with an N-pole threaded portion in a threaded lamp socket to realize electric conduction, and when the plug-in lamp holder is connected to the threaded lamp socket, axial plugging and unplugging can be performed.

The center of the insulation base is provided with a stepped groove, the middle of the top cover is provided with a guide groove downward, the center of the L-pole conductive cap is provided with a blind hole and the top is provided with a boss, the top of the L-pole conductive spring extends into the guide groove and resists it and the bottom of the L-pole conductive spring extends into the blind hole and resists it so that the L-pole conductive spring generates elastic compression, the bottom of the L-pole conductive cap extends outward from a small inner diameter hole of the stepped groove, and the boss is matched with a large inner diameter hole of the stepped groove to axially limit the L-pole conductive cap.

The middle of the N-pole conductive caps is provided with a convex step and the tail is provided with a cylinder, wherein the convex step is matched with the accommodating grooves and the conductive cap holes to axially limit the N-pole conductive caps, and the N-pole conductive caps are sleeved on the cylinder.

The insulation base is provided with a threaded hole, and at least two screws are fitted and connected to the threaded hole after passing through the top cover to fix the top cover and the insulation base.

The N-pole conductive caps are uniformly distributed along the circumferential direction.

The height positions of the N-pole conductive caps are inconsistent, and are matched with an N-pole threaded portion in a threaded lamp socket.

The lamp cap is made of aluminum, the insulation base and the top cover are made of plastics, and the L-pole conductive cap and the N-pole conductive caps are made of copper.

The L-pole conductive spring is electrically connected with an L-pole wire, the N-pole conductive springs are electrically connected with an N-pole wire, and the L-pole wire and the N-pole wire are respectively connected inside a lamp where the plug-in lamp holder is located.

The technical solution adopted by the lamp of the present invention is as follows: the lamp of the present invention comprises a plug-in lamp holder, wherein the plug-in lamp holder comprises a lamp cap, an insulation base, a top cover, an L-pole conductive cap, an L-pole conductive spring, at least two N-pole conductive caps and at least two N-pole conductive springs, wherein the top cover is fixedly connected to the insulation base, the L-pole conductive cap extends from the bottom of the center of the insulation base for tight contact with an L-pole contact in a threaded lamp socket to realize electric conduction, the two ends of the L-pole conductive spring are compressed against the insulation base and the L-pole conductive cap respectively so that the L-pole conductive cap can be elastically stretched, the lamp cap is sleeved and fixed on the outer wall of the insulation base, the lamp cap is isolated from the L-pole conductive cap by the insulation base, each N-pole conductive spring is electrically connected, the side wall of the lamp cap is provided with at least two conductive cap holes, the side wall of the insulation base is provided with at least two accommodating grooves, the position of the conductive cap holes is adapted to the position of the accommodating grooves, the N-pole conductive springs are placed in the accommodating grooves, the heads of the N-pole conductive caps protrude outward from the conductive cap holes, the tails of the N-pole conductive caps are placed in the accommodating grooves and resist the N-pole conductive springs to compress them so that the N-pole conductive caps can be elastically stretched for tight contact with an N-pole threaded portion in a threaded lamp socket to realize electric conduction, and when the plug-in lamp holder is connected to the threaded lamp socket, axial plugging and unplugging can be performed.

The center of the insulation base is provided with a stepped groove, the middle of the top cover is provided with a guide groove downward, the center of the L-pole conductive cap is provided with a blind hole and the top is provided with a boss, the top of the L-pole conductive spring extends into the guide groove and resists it and the bottom of the L-pole conductive spring extends into the blind hole and resists it so that the L-pole conductive spring generates elastic compression, the bottom of the L-pole conductive cap extends outward from a small inner diameter hole of the stepped groove, and the boss is matched with a large inner diameter hole of the stepped groove to axially limit the L-pole conductive cap.

The middle of the N-pole conductive caps is provided with a convex step and the tail is provided with a cylinder, wherein the convex step is matched with the accommodating grooves and the conductive cap holes to axially limit the N-pole conductive caps, and the N-pole conductive caps are sleeved on the cylinder.

The insulation base is provided with a threaded hole, and at least two screws are fitted and connected to the threaded hole after passing through the top cover to fix the top cover and the insulation base.

The N-pole conductive caps are uniformly distributed along the circumferential direction.

The height positions of the N-pole conductive caps are inconsistent, and are matched with an N-pole threaded portion in a threaded lamp socket.

The lamp cap is made of aluminum, the insulation base and the top cover are made of plastics, and the L-pole conductive cap and the N-pole conductive caps are made of copper.

The L-pole conductive spring is electrically connected with an L-pole wire, the N-pole conductive springs are electrically connected with an N-pole wire, and the L-pole wire and the N-pole wire are respectively connected inside a lamp where the plug-in lamp holder is located.

The lamp further comprises a heat-dissipating light source board with several LEDs, a light-transmitting bulb casing, a heat-dissipating cup and an insulation cup, wherein the upper and lower portions of the insulation cup are respectively fixedly connected to the light-transmitting bulb casing and the lamp cap, the heat-dissipating light source board is electrically connected to the L-pole conductive spring and the N-pole conductive springs through an L-pole wire and an N-pole wire respectively, the back of the heat-dissipating substrate is in contact with the bottom plate, and the heat-dissipating cup is located in the insulation cup and is in contact with the heat-dissipating light source board to conduct the heat generated by the light.

The beneficial effects of the present invention are as follows: the plug-in lamp holder of the present invention comprises a lamp cap, an insulation base, a top cover, an L-pole conductive cap, an L-pole conductive spring, at least two N-pole conductive caps and at least two N-pole conductive springs, wherein the top cover is fixedly connected to the insulation base, the L-pole conductive cap extends from the bottom of the center of the insulation base for tight contact with an L-pole contact in a threaded lamp socket to realize electric conduction, the two ends of the L-pole conductive spring are compressed against the insulation base and the L-pole conductive cap respectively so that the L-pole conductive cap can be elastically stretched, the lamp cap is sleeved and fixed on the outer wall of the insulation base, the lamp cap is isolated from the L-pole conductive cap by the insulation base, each N-pole conductive spring is electrically connected, the side wall of the lamp cap is provided with at least two conductive cap holes, the side wall of the insulation base is provided with at least two accommodating grooves, the position of the conductive cap holes is adapted to the position of the accommodating grooves, the N-pole conductive springs are placed in the accommodating grooves, the heads of the N-pole conductive caps protrude outward from the conductive cap holes, the tails of the N-pole conductive caps are placed in the accommodating grooves and resist the N-pole conductive springs to compress them so that the N-pole conductive caps can be elastically stretched for tight contact with an N-pole threaded portion in a threaded lamp socket to realize electric conduction, and when the plug-in lamp holder is connected to the threaded lamp socket, axial plugging and unplugging can be performed; the present invention breaks through the traditional way of thinking inherent in this field; by using the L-pole conductive cap in the center as an L-pole elastic contact, it can be ensured that the lamp holder can be inserted in any direction to realize good contact with the lamp socket; the N-pole conductive caps on the side distributed along the thread direction are used as N-pole elastic thimbles; when the lamp holder is inserted and removed, the N-pole conductive caps on the side shrink into the accommodating grooves under the action of external force, thereby smoothly plugging and unplugging and realizing the change from an original spiral lamp holder to a pluggable type, and it is adapted to a traditional spiral lamp socket so that it is convenient to use and quick to install; therefore, the plug-in lamp holder of the present invention is simple in structure and appearance and convenient for installation and use.

In the same way, the lamp of the present invention also has the above-mentioned advantages.

BRIEF DESCRIPTION OF THE ATTACHED DRAWINGS

EMBODIMENTS

Figure 1:
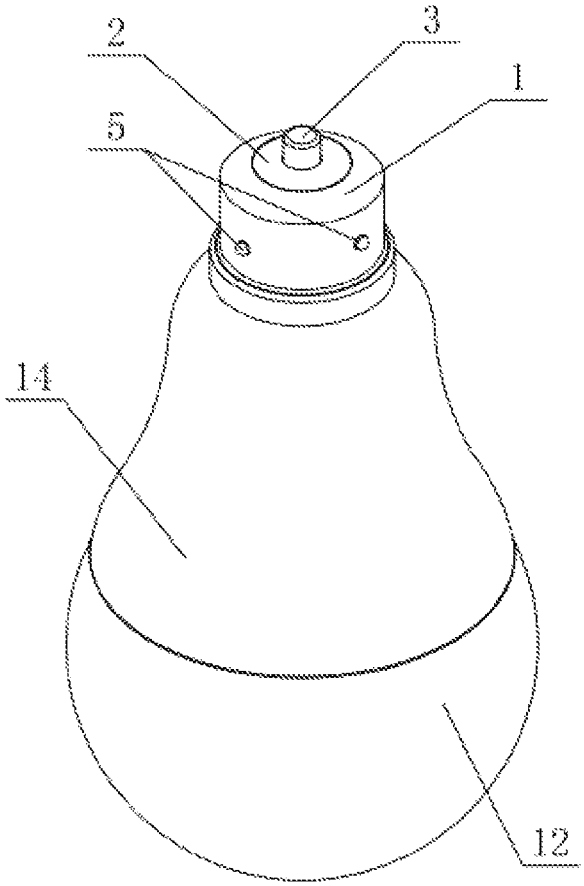
FIG. 1 is a schematic diagram of an overall structure of the lamp of an embodiment of the present invention.
Figure 2:
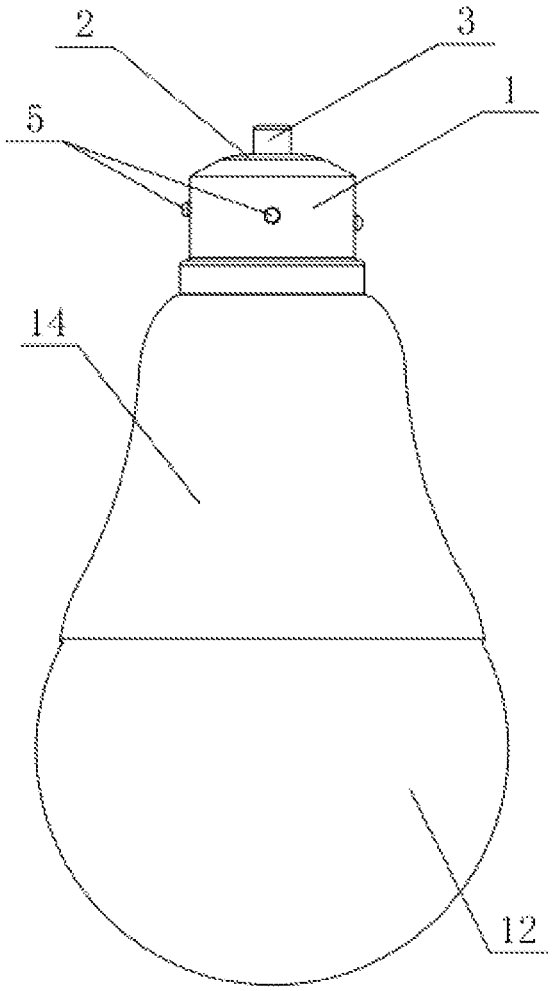
FIG. 2 is a schematic diagram of a side structure of the lamp of an embodiment of the present invention.
Figure 3:
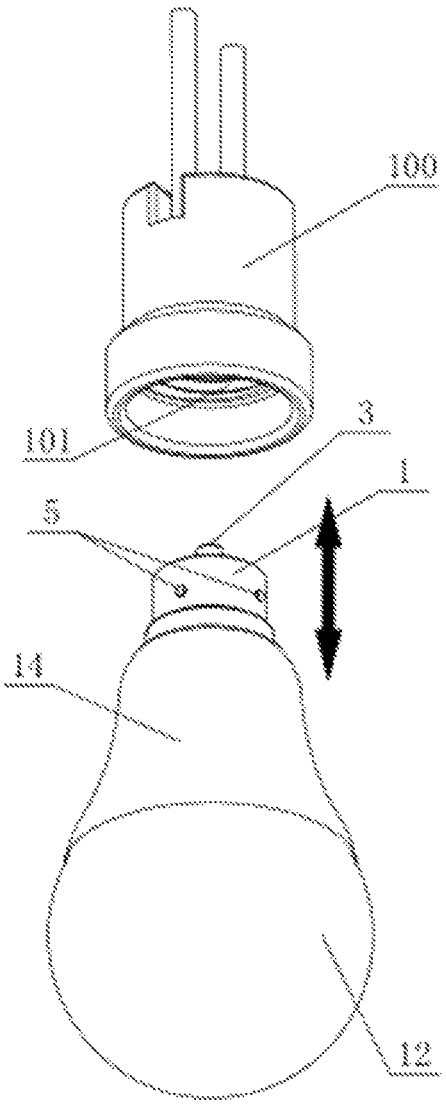
FIG. 3 is a schematic diagram of a structure of the connection between the lamp and the lamp socket of an embodiment of the present invention.
Figure 4:
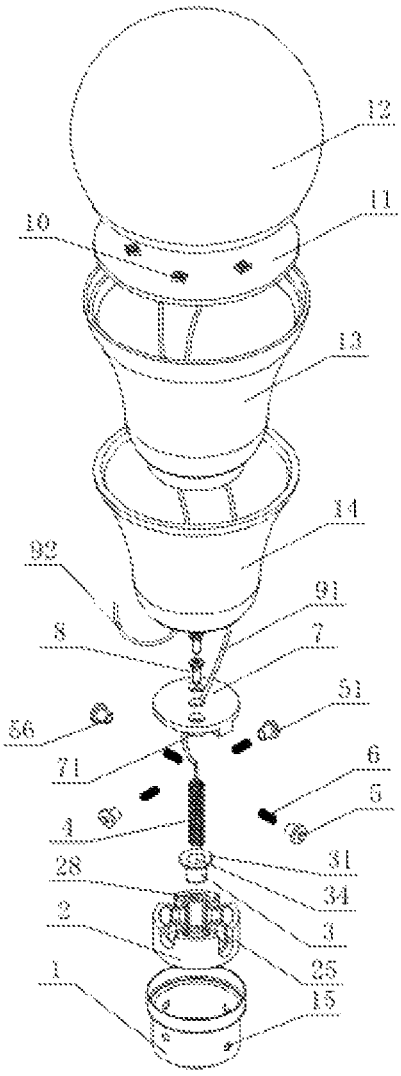
FIG. 4 is a schematic diagram of an explosive structure of the lamp of an embodiment of the present invention.
Figure 5:
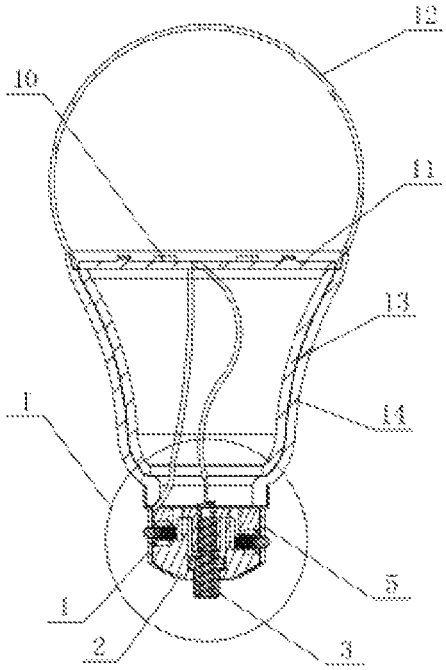
FIG. 5 is a schematic diagram of a sectional structure of the lamp of an embodiment of the present invention.
Figure 6:
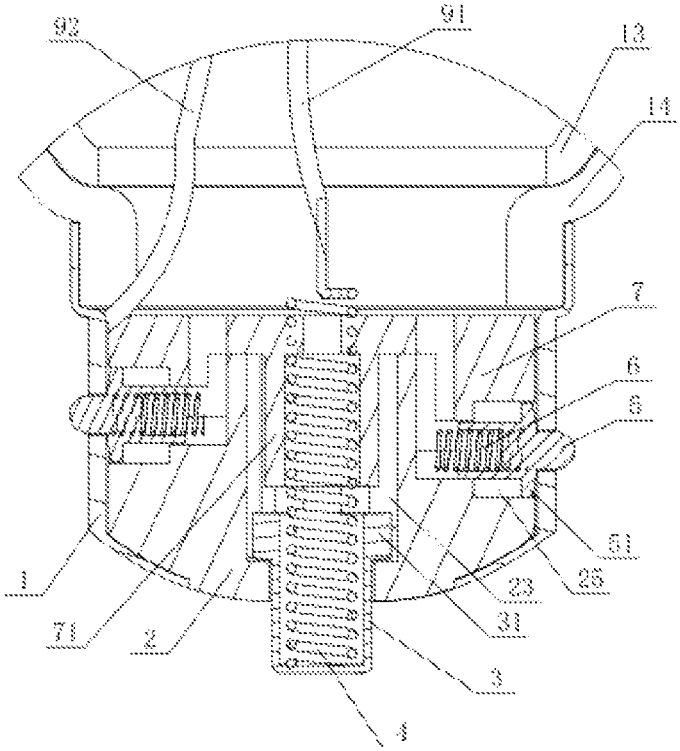
FIG. 6 is a schematic diagram of a partial enlarged structure at I as shown in FIG. 5.

As shown in FIGS. 1 to 6, the plug-in lamp head of the present embodiment comprises a lamp cap 1, an insulation base 2, a top cover 7, an L-pole conductive cap 3, an L-pole conductive spring 4, four N-pole conductive caps 5 and four N-pole conductive springs 6, wherein the top cover 7 is fixedly connected to the insulation base 2. In the present embodiment, the specific implementation manner is as follows: the insulation base 2 is provided with a threaded hole 28, and two screws 8 pass through the top cover 7 and then are fitted with the threaded hole 28 to fix the top cover 7 and the insulation base 2; the L-pole conductive cap 3 extends from the bottom of the center of the insulation base 2 for tight contact with an L-pole contact in a threaded lamp socket 100 for electric conduction; and the two ends of the L-pole conductive spring 4 are compressed against the insulation base 2 and the L-pole conductive cap 3 respectively so that the L pole conductive cap 3 can be elastically stretched. In the present embodiment, the specific implementation manner is as follows: the center of the insulation base 2 is provided with a stepped groove 23, the middle of the top cover 7 is provided with a guide groove 71 downward, the center of the L-pole conductive cap 3 is provided with a blind hole 34 and the top is provided with a boss 31, the top of the L-pole conductive spring 4 extends into the guide groove 71 and resists it, the bottom of the L-pole conductive spring 4 extends into the blind hole 34 and resists it so that the L-pole conductive spring 4 is elastically compressed, the bottom of the L-pole conductive cap 3 extends outward from a small inner diameter hole of the stepped groove 23, and the boss 31 is matched with a large inner diameter hole of the stepped groove 23 to axially limit the L-pole conductive cap 3; the lamp cap 1 is sleeved and fixed on the outer wall of the insulation base 2, the lamp cap 1 and the L-pole conductive cap 3 are isolated by the insulation base 2, the N-pole conductive springs 6 are electrically connected, the side wall of the lamp cap 1 is provided with four conductive cap holes 15, the side wall of the insulation base 2 is provided with four accommodating grooves 25, the position of the conductive cap holes 15 matches the position of the accommodating grooves 25, the N-pole conductive springs 6 are placed in the accommodating grooves 25, the heads of the N-pole conductive caps 5 extend outward from the conductive cap holes 15, and the tails of the N-pole conductive caps 5 are placed in the accommodating grooves 25 and resist the N-pole conductive springs 6 to compress them so that the N-pole conductive caps 5 can be elastically stretched for tight contact with an N-pole threaded portion in a threaded lamp socket 100 for electric conduction. In the present embodiment, the specific implementation manner is as follows: a convex step 51 is provided in the middle of the N-pole conductive caps 5, and a cylinder 56 is provided at the tail, the convex step 51 is adapted to the accommodating grooves 25 and the conductive cap holes 15 to axially limit the N-pole conductive caps 5, the N-pole conductive caps 5 are sleeved on the cylinder 56, the L-pole conductive spring 4 is electrically connected to an L-pole wire 91, the N-pole conductive springs 6 are electrically connected to an N-pole wire 92, the L-pole wire 91 and the N-pole wire 92 are respectively connected to the lamp where the plug-in lamp holder is located, the N-pole conductive caps 5 are evenly distributed in the circumferential direction, and in the present embodiment, they are arranged at an interval of 90° in the circumferential direction, the height positions of the N-pole conductive caps 5 are inconsistent and are matched with an N-pole threaded portion in a threaded lamp socket 100, which is convenient for being fixed with the threaded lamp socket, and when the plug-in lamp holder is connected to the threaded lamp socket 100, axial plugging and unplugging can be performed. In the present embodiment, the lamp cap 1 is made of aluminum, the insulation base 2 and the top cover 7 are made of plastics, and the L-pole conductive cap 3 and the N-pole conductive caps 5 are made of copper.

The lamp of the present embodiment is an LED bulb, comprising a plug-in lamp holder as described above, and a heat-dissipating light source board 11 with several LEDs 10, a light-transmitting bulb casing 12, a heat-dissipating cup 13 and an insulation cup 14, wherein the upper and lower portions of the insulation cup 14 are respectively fixedly connected to the light-transmitting bulb casing 12 and the lamp cap 1, the heat-dissipating light source board 11 is electrically connected to the L-pole conductive spring 4 and the N-pole conductive springs 6 through an L-pole wire 91 and an N-pole wire 92 respectively, the back of the heat-dissipating substrate 14 is in contact with the bottom plate 31, and the heat-dissipating cup 13 is located in the insulation cup 14 and is in contact with the heat-dissipating light source board 11 to conduct the heat generated by the light.

The above embodiments are only examples and are not intended to limit the scope of protection of the present invention. For example, the number of the N-pole conductive caps 5, the N-pole conductive springs 6, the conductive cap holes 15, the accommodating grooves 25, the LEDs 10, the screws 8 and the threaded holes 28 are not limited to what is described in the embodiments; the lamp of the present invention is not limited to an LED bulb, and it can be other types of light sources or lamps and it should fall within the protection scope of the present invention as long as the plug-in lamp holder of the present invention is applied.

The present invention breaks through the traditional way of thinking inherent in the field. By using the L-pole conductive cap 3 in the center as an L-pole elastic contact, it can be ensured that the lamp holder can be inserted in any direction to realize good contact with the lamp socket. The N-pole conductive caps 5 distributed along the thread direction on the side are used as N-pole elastic thimbles. When the lamp holder is inserted and removed, the N-pole conductive caps 5 on the side shrink into the accommodating grooves 25 (namely the lamp holder) under the action of external force, thereby smoothly plugging and unplugging and realizing the change from an original spiral lamp holder to a pluggable type, and it is adapted to a traditional spiral lamp socket so that it is convenient to use and quick to install. Therefore, the plug-in lamp holder of the present invention is simple in structure and appearance and convenient for installation and use; and in the same way, the lamp of the present invention also has the above-mentioned advantages.

The present invention can be widely used in the field of lighting appliances.

The invention claimed is:

1. A plug-in lamp holder, comprising: a lamp cap, an insulation base, a top cover, an L-pole conductive cap, an L-pole conductive spring, at least two N-pole conductive caps and at least two N-pole conductive springs, wherein the top cover is fixedly connected to the insulation base, the L-pole conductive cap extends from the bottom of the center of the insulation base for tight contact with an L-pole contact in a threaded lamp socket to realize electric conduction, the two ends of the L-pole conductive spring are compressed against the insulation base and the L-pole conductive cap respectively so that the L-pole conductive cap can be elastically stretched, wherein the lamp cap is sleeved and fixed on an outer wall of the insulation base, the lamp cap is isolated from the L-pole conductive cap by the insulation base, each N-pole conductive spring is electrically connected, wherein a side wall of the lamp cap is provided with at least two conductive cap holes, a side wall of the insulation base is provided with at least two accommodating grooves, the position of the conductive cap holes is adapted to the position of the accommodating grooves, the N-pole conductive springs are placed in the accommodating grooves, heads of the N-pole conductive caps protrude outward from the conductive cap holes, tails of the N-pole conductive caps are placed in the accommodating grooves so as to resist the N-pole conductive springs and to compress them so that the N-pole conductive caps can be elastically stretched for tight contact with an N-pole threaded portion in a threaded lamp socket to realize electric conduction, and wherein when the plug-in lamp holder is connected to the threaded lamp socket, axial plugging and unplugging can be performed.

2. The plug-in lamp holder according to claim 1, comprising: a center of the insulation base is provided with a stepped groove, a middle of the top cover is provided with a guide groove downward, a center of the L-pole conductive cap is provided with a blind hole and the top of the L-pole conductive cap is provided with a boss, wherein the top of the L-pole conductive spring extends into the guide groove and resists it and the bottom of the L-pole conductive spring extends into the blind hole and resists it so that the L-pole conductive spring generates elastic compression, the bottom of the L-pole conductive cap extends outward from a small inner diameter hole of the stepped groove, and wherein the boss is matched with a large inner diameter hole of the stepped groove to axially limit the L-pole conductive cap.

3. The plug-in lamp holder according to claim 1, comprising: the middle of the N-pole conductive caps is provided with a convex step and the tail is provided with a cylinder, wherein the convex step (51) is matched with the accommodating grooves and the conductive cap holes to axially limit the N-pole conductive caps, and wherein the N-pole conductive springs are located within the cylinder.

4. The plug-in lamp holder according to claim 1, comprising: the insulation base is provided with at least two threaded hole, and wherein at least two screws are fitted and connected to the threaded holes after passing through the top cover to fix the top cover and the insulation base.

5. The plug-in lamp holder according to claim 1, comprising: each of the N-pole conductive caps are evenly distributed along the circumferential direction of the lamp cap.

6. The plug-in lamp holder according to claim 1, comprising: the height positions of the N-pole conductive caps are inconsistent, and are matched with an N-pole threaded portion in a threaded lamp socket.

7. The plug-in lamp holder according to claim 1, comprising: the lamp cap is made of aluminum, the insulation base and the top cover are made of plastics, and wherein the L-pole conductive cap and the N-pole conductive caps are made of copper.

8. The plug-in lamp holder according to claim 1, comprising: the L-pole conductive spring is electrically connected with an L-pole wire, wherein the N-pole conductive springs are electrically connected with an N-pole wire, and wherein the L-pole wire and the N-pole wire are respectively connected inside a lamp where the plug-in lamp holder is located.

9. A lamp, characterized in that it comprises the plug-in lamp holder according to claim 1.

10. The lamp according to claim 9, said lamp further comprising: a heat-dissipating light source board with several LEDs, a light-transmitting bulb casing, a heat-dissipating cup and an insulation cup, wherein upper and lower portions of the insulation cup are respectively fixedly connected to the light-transmitting bulb casing and the lamp cap, wherein the heat-dissipating light source board is electrically connected to the L-pole conductive spring and the N-pole conductive springs through an L-pole wire and an N-pole wire respectively, a back of the heat-dissipating cup is in contact with a bottom plate, and wherein the heat-dissipating cup is located in the insulation cup and is in contact with the heat-dissipating light source board to conduct the heat generated by the light.

* * * * *